US007681884B2

(12) United States Patent
Scrymgeour et al.

(10) Patent No.: US 7,681,884 B2
(45) Date of Patent: Mar. 23, 2010

(54) LOTTERY TICKET WITH PLAY ACTION GAME

(75) Inventors: Lyle Harold Scrymgeour, Oakbank (CA); Scott Jevne, Winnipeg (CA); Douglas Pollard, Winnipeg (CA); Brad Thompson, Winnipeg (CA); Julie-Anne McCallum, Winnipeg (CA)

(73) Assignee: Pollard Banknote Limited Partnership, Winnipeg, Manitoba (CA)

( * ) Notice: Subject to any disclaimer, the term of this patent is extended or adjusted under 35 U.S.C. 154(b) by 0 days.

(21) Appl. No.: 12/120,007

(22) Filed: May 13, 2008
(Under 37 CFR 1.47)

(65) Prior Publication Data

US 2008/0277872 A1 Nov. 13, 2008

Related U.S. Application Data

(62) Division of application No. 11/202,360, filed on Aug. 12, 2005, now Pat. No. 7,431,295.

(51) Int. Cl.
*A63F 3/06* (2006.01)

(52) U.S. Cl. ..... 273/269; 273/272; 273/139; 283/901; 283/903

(58) Field of Classification Search ..... 273/269, 273/272, 138.1, 139; 283/901, 903
See application file for complete search history.

(56) References Cited

U.S. PATENT DOCUMENTS

| | | | |
|---|---|---|---|
| 4,270,774 | A | 6/1981 | Barnes |
| 5,193,815 | A | 3/1993 | Pollard |
| 5,386,985 | A | 2/1995 | Paris |
| 5,657,991 | A | 8/1997 | Camarato |
| 5,685,541 | A | 11/1997 | Lovell, Sr. |
| 5,782,470 | A | 7/1998 | Langan |
| 6,241,246 | B1 | 6/2001 | Guttin et al. |

(Continued)

FOREIGN PATENT DOCUMENTS

GB 2 318 744 A 5/1998

(Continued)

OTHER PUBLICATIONS

Sudoku on Wikipedia: http://en.wikipedia.org/wiki/Sudoku.

(Continued)

*Primary Examiner*—Benjamin H Layno
(74) *Attorney, Agent, or Firm*—Adrian D. Battison; Ade & Company Inc.

(57) ABSTRACT

A lottery ticket has printed thereon a matrix of nine rows and nine columns defining eighty one locations some of which are pre-marked with numbers from 1 to 9 and is arranged such that the player can select and enter the numbers in open locations to provide an arrangement of the numbers in which the marked locations and the open locations contain a number selected from the numbers 1 to 9 where all columns and all rows have the nine locations thereof each containing one of the numbers 1 to 9 with each number appearing once only. Prizes are awarded, according to a set of rules relating to the lottery ticket, depending on the appearance of at least one of the numbers in at least one of the locations or depending on the total number of correct rows or columns or other matrix shape of nine locations.

7 Claims, 7 Drawing Sheets

U.S. PATENT DOCUMENTS

| | | | |
|---|---|---|---|
| 6,619,660 | B2 | 9/2003 | Schaefer et al. |
| 6,802,505 | B2 | 10/2004 | Jeon |
| 6,889,978 | B2 | 5/2005 | Schaefer et al. |
| 7,004,506 | B2 | 2/2006 | Downes et al. |
| 2007/0063432 | A1 | 3/2007 | Trudel et al. |

FOREIGN PATENT DOCUMENTS

| | | |
|---|---|---|
| WO | WO 00/23160 | 4/2000 |
| WO | WO 2004/112924 | 12/2004 |

OTHER PUBLICATIONS

"Sudoku" Wikipedia, the free encyclopedia, http://web.archive.org/web/20050517014559http://en.wikipedia.org/wiki/Sudoku, May 17, 2005.

Texas Lottery Commission, 2004: http://txlottery.org/news/photos/499sis/pdf.

Atlantic Lottery Corporation, 2003: http://web.archive.org/web/20051122072000/http:/www.alc.ca/English/ALCProducts/ScratchNWin.

Sudoku Variants, Jul. 23, 2005:—copy not available http://www.sudokuvariants.blogspot.com/.

Texas Lottery Commission, 2004:—copy not available http://web.archive.org/20030623225130/txtlottery.org/scratchoffs/activeticket.cfm?gnum=388.

LOGO

RULES

| | | | | | | | | |
|---|---|---|---|---|---|---|---|---|
| 2 | 9 | 6 | 7 | 8 | 1 | 3 | 4 | 5 |
| 4 | 5 | 6 | 4 | 2 | 3 | 3 | 9 | 8 |
| 9 | 8 | 1 | 3 | 7 | 4 | 4 | 5 | 2 |
| 4 | 7 | 6 | 5 | X | X | X | X | X |
| X | X | X | X | X | X | X | X | X |
| X | X | X | X | X | X | X | X | X |
| X | X | X | X | X | X | X | X | X |
| X | X | X | X | X | X | X | X | X |
| X | X | X | X | X | X | X | X | X |

X X X
X X X
X X X
X X X

PRIZES X X X $ X X
X X X $ X X
X X X $ X X

FIG. 3

LOTTERY TICKET WITH PLAY ACTION GAME

This application is a Divisional Application from application Ser. No. 11/202,360 filed Aug. 12, 2005 now U.S. Pat. No. 7,431,295.

This invention relates to a lottery ticket with play action game.

BACKGROUND OF THE INVENTION

A number of patent applications have been filed and patents granted for instant win lottery tickets which provide play action for the player in order to provide an extended play to increase player involvement and enjoyment.

Sudoku is a known numbers game using a matrix of eighty one locations in a nine by nine grid in which the player has to complete entry into each of the locations of a selected one of the numbers 1 to 9 in such a way that in each of the nine horizontal and vertical rows the numbers 1 to 9 appear only once and that within each of the smaller three by three grids the numbers 1 to 9 are used only one time as well. The matrix is set up initially using a limited set of prescribed numbers in selected ones of the locations to start. In play the player has to determine which number goes in which of the open locations in order to complete the grid.

SUMMARY OF THE INVENTION

It is one object of the present invention to provide an improved gaming ticket which provides an enhanced play for the player.

According to a first aspect of the invention there is provided a lottery ticket comprising:

a substrate having printed thereon:

a plurality of matrices each defining nine locations for a game symbol;

at least one of the locations being covered by a scratch-off coating such that a symbol therein is covered but can be exposed by a player removing the scratch-off coating;

wherein, according to a set of rules relating to the lottery ticket, a prize is won if a sufficient number of the matrices contains in each of the nine locations defined thereby a respective one of the numbers 1 to 9 with each number appearing once only.

The game provided on each substrate may be for prizes both monetary and product related or may be merely for entertainment where no gambling or prize is involved. The type and value of any prizes can vary widely. The games may be pre-determined, otherwise known as "instant win" tickets or may include elements of skill or chance.

The games concerned are preferably instant win type games where the result is entirely predetermined, since such games are generally preferred in a lottery situation in order to ensure that the total winnings is predetermined. However the present invention is not limited to the type of game to be played and can include probability or other games which include game indicia covered by a scratch-off coating.

The construction may also be used in situations where the main objective is for other purposes than gambling such as in promotional games or games of fun for children or others where no gambling or prizes are involved.

Many such tickets are used directly in a lottery situation so that the tickets have no other relevance other than the playing of the lottery or game by which the player may win monetary or other prizes as part of the lottery or gaming situation. However attention has been recently given to other uses of such tickets such as promotional items used by manufacturers of other products to enhance the sale of the product, or as part of packaging or in other situations where the substrate acts in another capacity and the lottery ticket aspect is merely one part of its function.

In some examples of the game, all of the locations are covered by scratch-off material.

Alternatively only some the locations are covered by scratch-off material.

In another alternative arrangement, at least one of the numbers associated with a respective one of the locations is positioned on the substrate at a different position than at the location and is covered by scratch-off material.

In one arrangement there are nine matrices arranged in three by three grids.

In another arrangement, the matrices are arranged in nine rows and nine columns to form a complete grid of nine by nine defining a total number of eighty one locations.

According to a second aspect of the invention there is provided a lottery ticket for playing by a player comprising:

a substrate having printed thereon:

a matrix of nine rows and nine columns defining eighty one locations each for a game symbol;

some but not all of the locations being marked locations which have marked therein a number selected from the numbers 1 to 9;

all of the locations which are not marked locations being open locations having an open area in which the player can enter a number selected from the numbers 1 to 9;

the marked locations having the numbers thereof arranged such that all of the locations including the marked locations and the open locations can be arranged to contain a number selected from the numbers 1 to 9 where all columns and all rows have the nine locations thereof each containing one of the numbers 1 to 9 with each number appearing once only;

such that the player can select and enter the numbers in the open locations to provide an arrangement of the numbers in which the marked locations and the open locations contain a number selected from the numbers 1 to 9 where all columns and all rows have the nine locations thereof each containing one of the numbers 1 to 9 with each number appearing once only wherein, according to a set of rules relating to the lottery ticket, a prize is won depending on the appearance of at least one of the numbers in at least one of the locations.

Preferably the at least one of the numbers comprises a prescribed number and wherein the at least one of the locations is at least one prescribed location. However other prize schemes can be used to define prizes depending on the location relative to the grid of certain numbers which are preselected on the ticket.

Preferably the prescribed number is printed on the substrate and covered by a scratch-off coating.

Preferably the at least one prescribed location is visually differentiated from other locations.

Preferably there is provided on the substrate a second matrix identical to the first matrix with the arrangement of the numbers in which the marked locations and the open locations contain a number selected from the numbers 1 to 9 where all columns and all rows have the nine locations thereof each containing one of the numbers 1 to 9 with each number appearing once only wherein at least those locations on the second matrix which correspond to the open locations of the first matrix are covered by a scratch-off material removable by the player.

A number of options for a game ticket are as follows:

Option A

Has an 81 space grid (traditional 9×9) completely covered in opaque latex. The player will remove the latex and then determine if the 9 horizontal and 9 vertical lines each contain the numbers 1 to 9 in any order. Prize values will depend on the number of lines the player finds, which are complete. For example if there are 10 correct lines in total then the player would win the minimum prize level. The prize level increases as the number of complete lines, included on the card, are found. This play format allows for 9 prize levels and is completely adjustable.

Option B

The card has the same 81 square grid but only certain numbers in each of the grids would be covered (ie 3 squares per small grid). Players scratch the individual coverings and determine as described above in A what the results are.

Option C

The ticket has 9 separate 3×3 grids, which feature 7 of 9 numbers required to complete the small grid. Two spaces are left blank. Adjacent to each small grid is a separate opaque scratch-off, which covers "Your Numbers" for each play area and an accompanying prize box. In play the person removes the latex covering each of the "Your Numbers" and if the two numbers found below the opaque scratch-off are the ones required to complete the grid then they win the prize shown in the prize box for the particular grid.

Option D

The ticket has 9 separate 3×3 grids. Each grid has the first 6 squares (2 across×3 high) visible but the last three vertical squares are covered with opaque scratch-off and there is a prize box attached to each of them covered as well. The player removes the latex over the hidden 3 vertical squares to determine if they have the full set of 9 numbers, 1 to 9. If they do then they win the prize shown in the adjoining prize box.

Option E

The ticket has four areas involved in the play:

- A hidden (covered by scratch-off) number(s) to match from 1 to 9.
- A hidden prize box either with or separate from the Number(s) to Match.
- A nine by nine grid with the starting numbers filled in. The grid also contains one or more coloured markings under some blank positions within the grid. The player plays the game and once complete scratch-off the number to match to determine whether they have the correct number contained in one or more of the red areas in which case they win an associated prize.
- A complete version of the same game with the same markings but which is covered by opaque latex and is therefore hidden from view. Player has the option to remove some or all of the latex to assist in playing the game or in lieu of playing the game. The same completed grid is used at the time of validation to verify the correct combination in case there is a dispute as a result of an error by the player.

BRIEF DESCRIPTION OF THE DRAWINGS

One embodiment of the invention will now be described in conjunction with the accompanying drawings in which:

FIG. 3 is a plan view of the tickets of FIG. 1 or FIG. 2 after the removal of the scratch-off coating.

In the drawings like characters of reference indicate corresponding parts in the different figures.

DETAILED DESCRIPTION

The figures and the description herein shows further detail and further examples of the different options described above.

Figure 1:
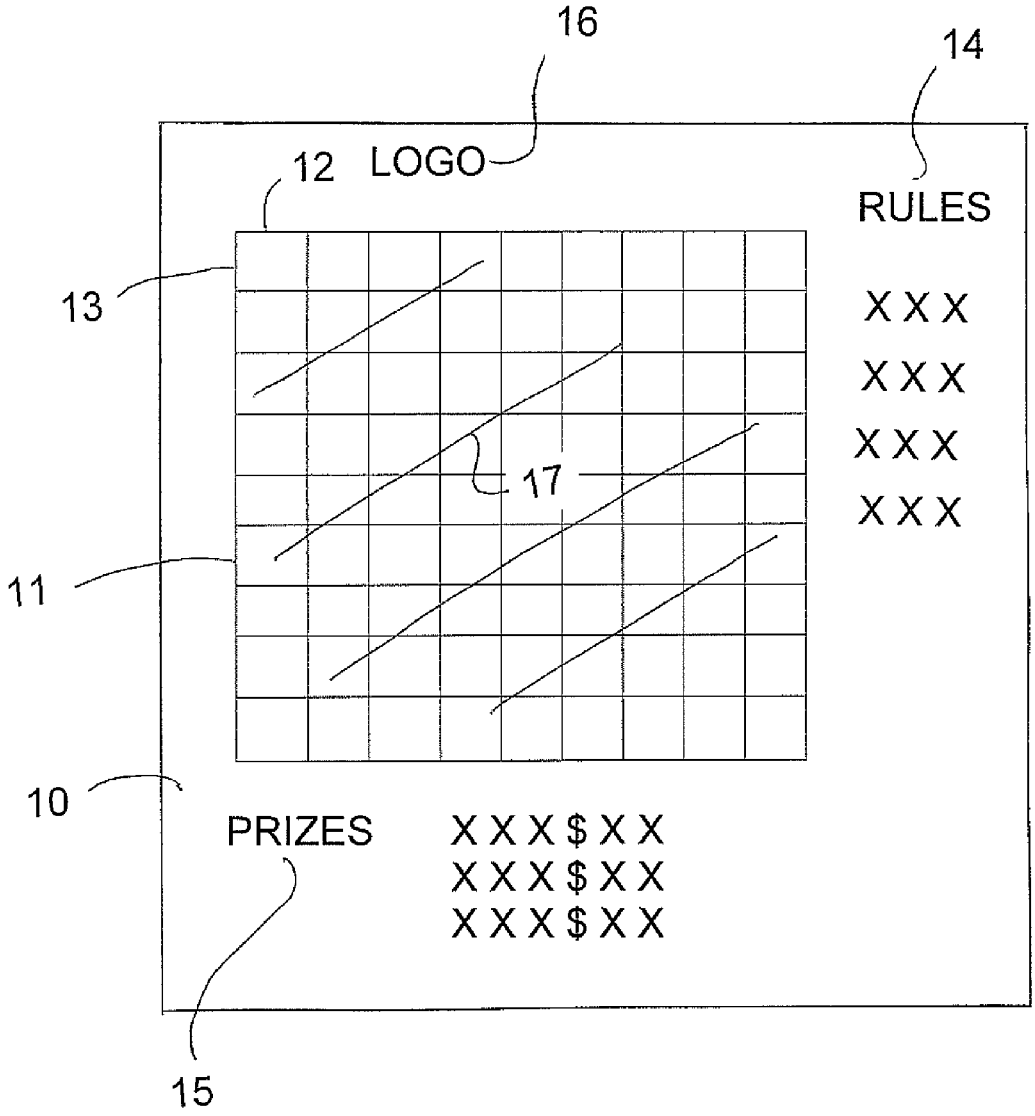
FIG. 1 is a plan view of a game ticket according to the present invention showing a matrix of a nine by nine grid of 81 locations in which the data printed in the matrix is covered by a scratch-off coating.
Figure 2:
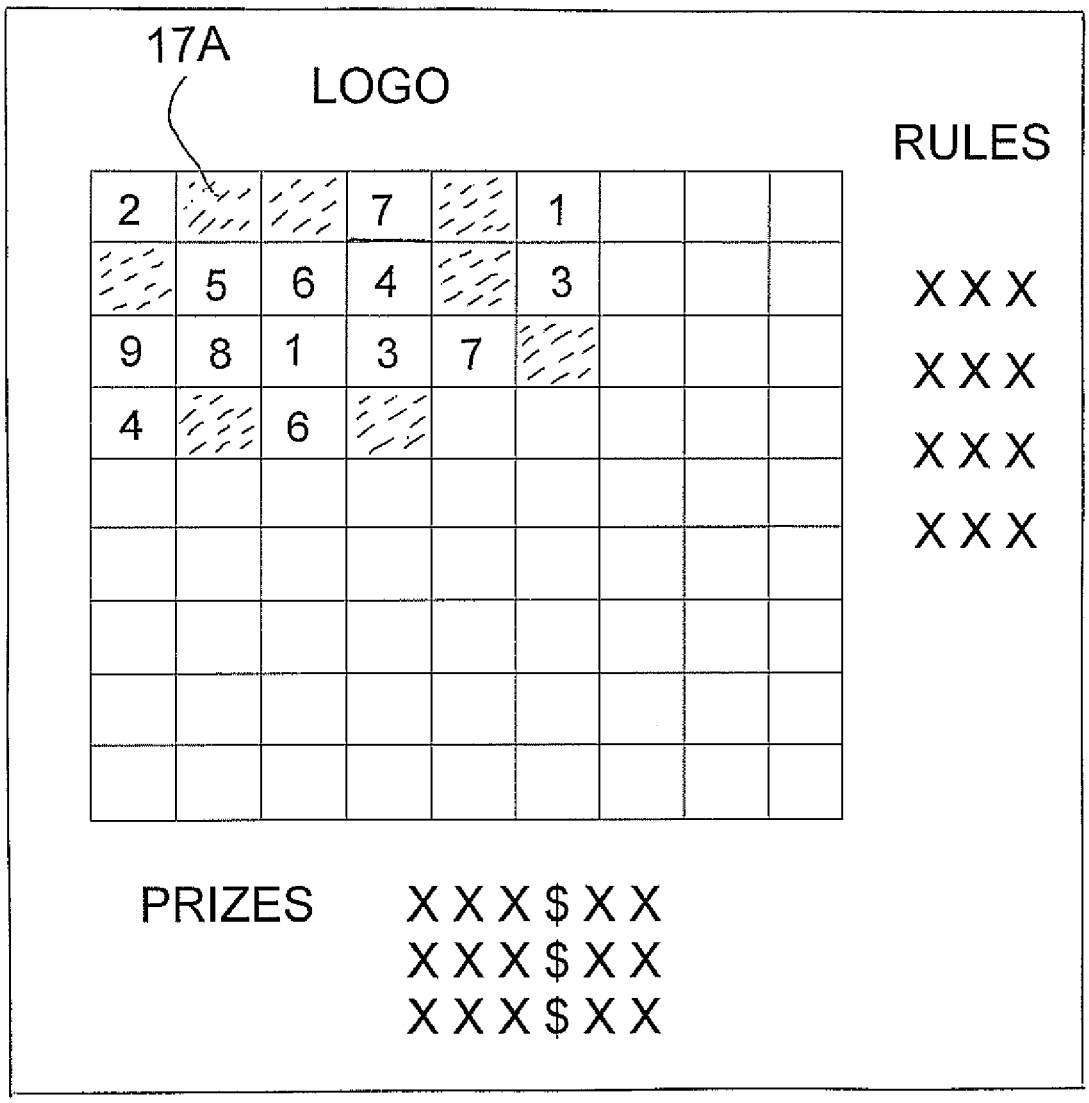
FIG. 2 shows a similar ticket to that of FIG. 1 in which some of the data in the grid is exposed and some of the locations are covered by a scratch-off coating.

In the arrangements of FIG. 1, 2 and 3, the substrate 10 carries a matrix 11 which has nine rows 13 and nine columns 12 arranged to form a square defining eighty one locations.

The basic intention of the game is that each row and each column should contain the numbers 1 to 9 with each number being included only once.

The game can be rendered more complicated by also requiring that each matrix of nine locations defined by three columns and three rows also includes the numbers 1 to 9 including each number only once.

The embodiments of FIGS. 1 to 3 simulate a game of this type in that the player simply removes a scratch-off coating to expose the numbers printed underneath and then calculates the number of rows and columns and/or three by three grids which contain properly the numbers 1 to 9 once each with no duplication. Thus a prize can be paid depending upon the total number of such columns, rows and/or grids which properly include the required numerals.

The rules for this game are set out in a section indicated at 14 and the prizes are set out at 15. The game includes a game name or logo as indicated at 16.

In the embodiment of FIG. 1 all of the locations are covered by a scratch-off coating as indicated schematically at 17.

In FIG. 2 there is a similar arrangement with the only difference being that some of the locations are already exposed when the ticket is sold and some are covered by scratch-off coating as indicated at 17A. Thus the scratching required is significantly reduced. Thus the game provides a series of numbers which are already exposed when the ticket is purchased thus providing a more attractive appearance.

In FIG. 3 is shown schematically an arrangement in which the scratch-off coating has been removed and some of the rows are exposed showing that the top row is properly a winning row containing all of the numbers 1 to 9 with each number being included only once. The second and third rows are not winning rows since some of the numbers are duplicated. For convenience of illustration the numerals in other rows are not particularly identified but the reader will appreciate the concept.

Figure 4:
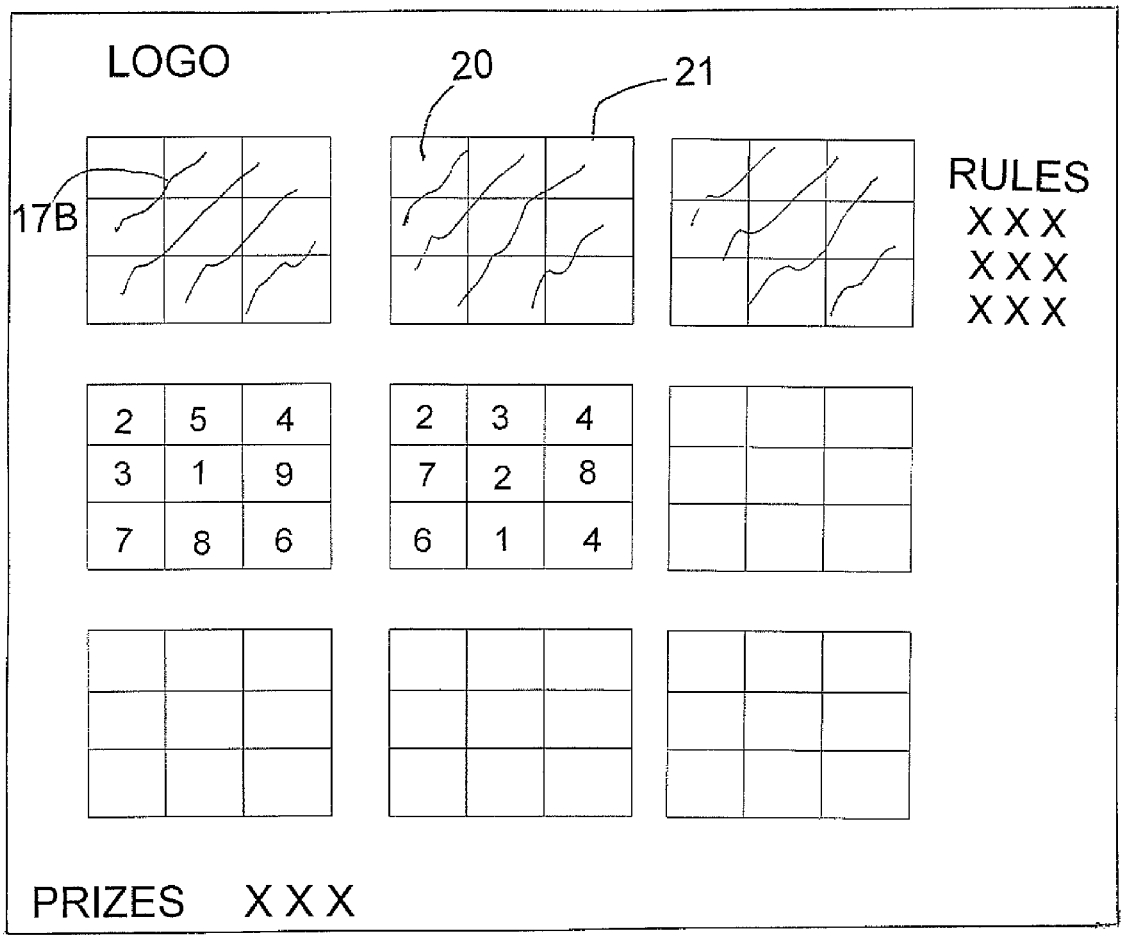
FIG. 4 is a top plan view of another embodiment of the ticket according to the present invention showing nine individual matrixes with some of the matrixes covered by scratch-off coating and some in which the scratch-off coating has been removed.
Figure 5:
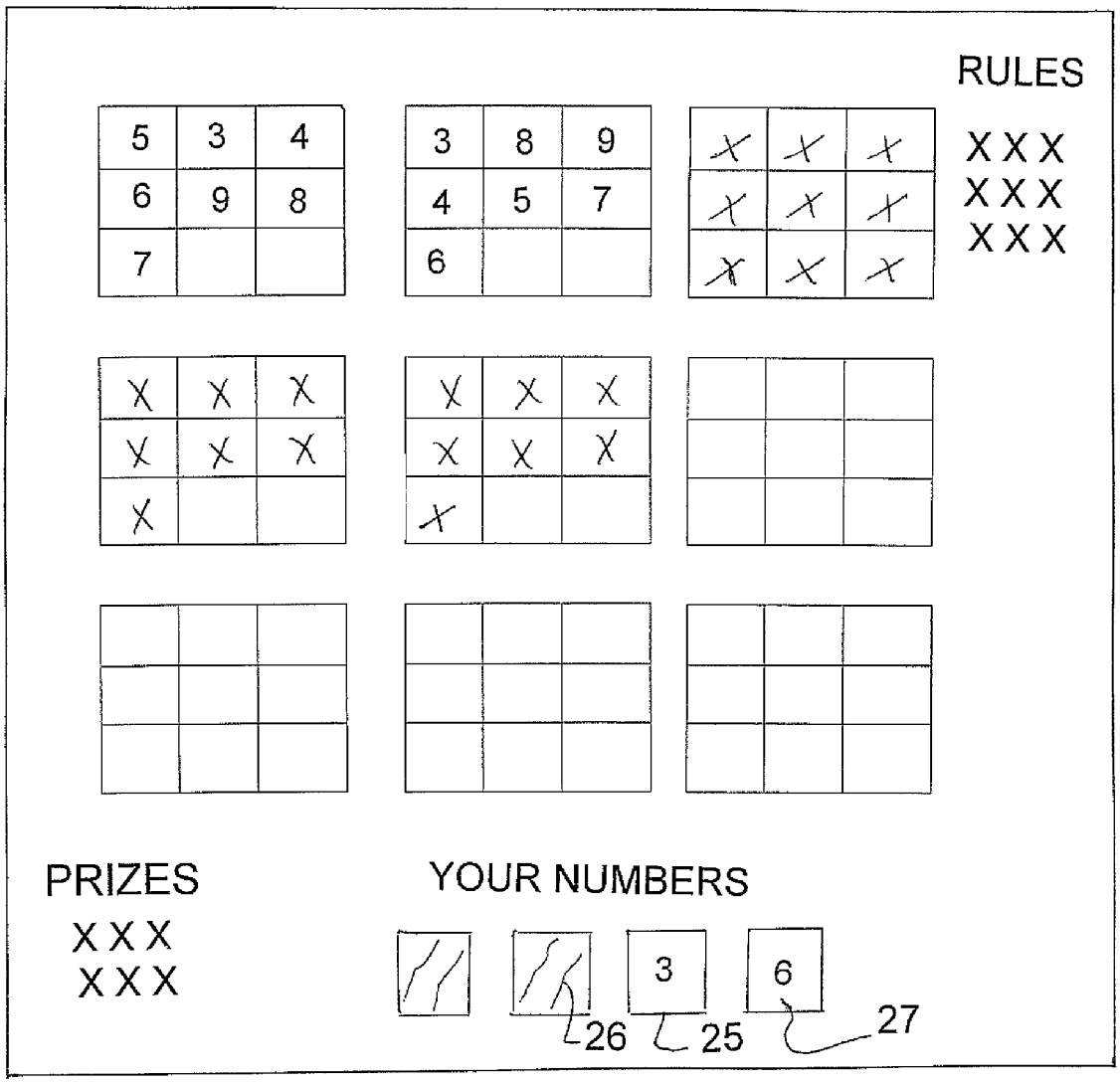
FIG. 5 is a top plan view of yet another embodiment in which there are nine individual matrixes with the some of the locations in the matrixes blank and a separate section of numbers for playing by the player which are covered by a scratch-off coating.
Figure 6:
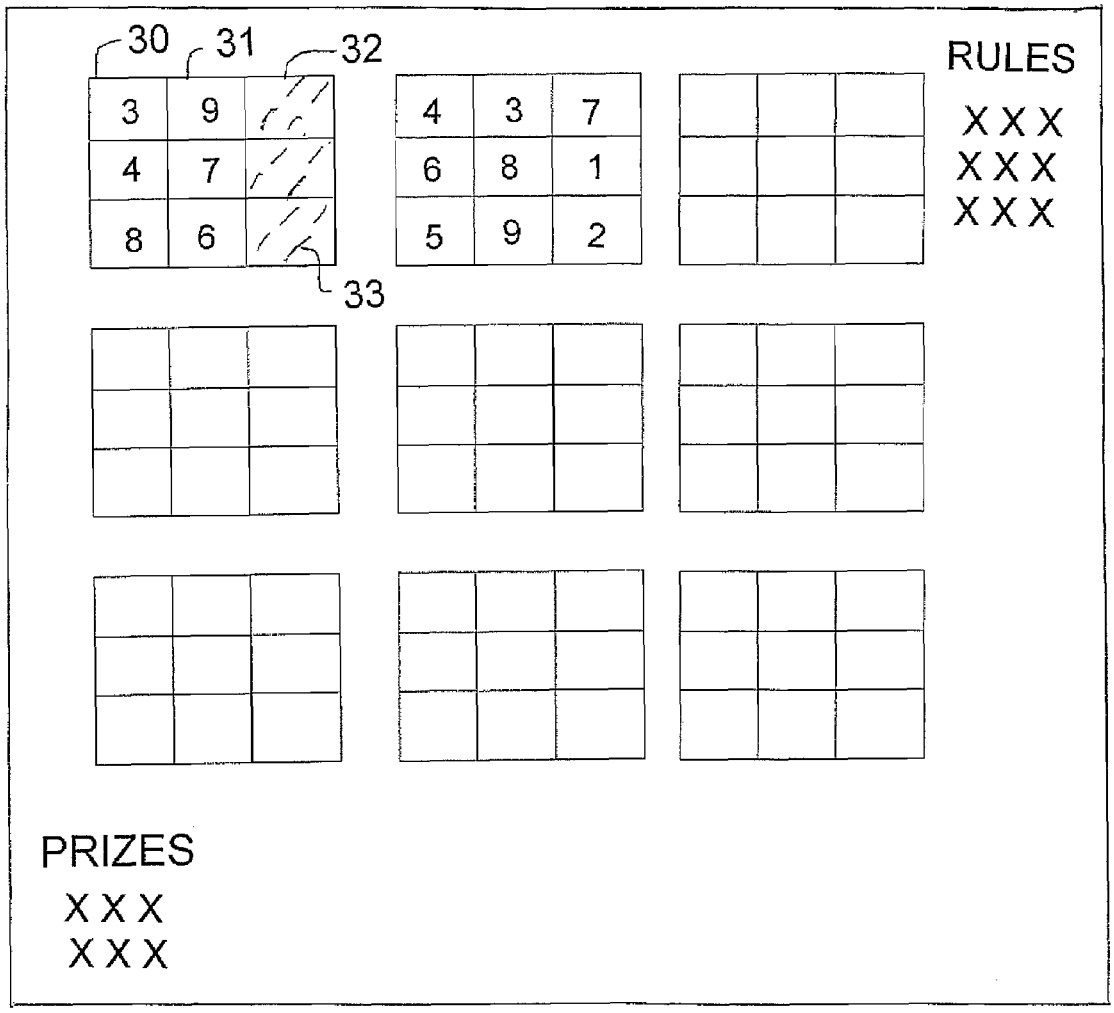
FIG. 6 is yet another embodiment utilizing the nine individual matrixes in which six of the locations in each matrix are exposed and three are covered by scratch-off coating and in which some of the scratch-off coatings have been removed.

In FIGS. 4, 5 and 6 is shown a further alternative arrangement of this type which is simplified for possibly less sophisticated players. In this arrangement the game is divided into nine individual matrixes each of nine locations arranged in three by three grids. The game is basically played in the same manner in that some or all of the individual locations 20 of the grids 21 are covered by a scratch-off coating indicated at 17B. In the embodiment of FIG. 4, it is intended that all of the locations of all of the matrixes are covered by the scratch-off coating and the player simply removes all of the scratch-off coating to expose the nine individual matrixes. A prize is then paid depending upon the number of matrixes which properly contain the numbers 1 to 9 without any duplications.

In FIG. 5 is shown an alternative arrangement in which the locations in the matrixes are not covered by scratch-off coating but instead each matrix leaves blank one or more of the locations. In the embodiment shown in FIG. 5 two of the locations are left blank. In this embodiment a separate section indicated at "your numbers" provides a series of individual locations numerical 25 which are covered by scratch-off coating 26 which can be removed to expose the players numbers 27. The player then applies these numbers into the blank spaces in the individual matrixes and wins a prize if a predetermined number of the matrixes properly contains the numbers 1 to 9. The player's numbers, indicated at "your numbers" may be combined into a single area as shown but more preferably are different numbers for each matrix and located adjacent to the related matrix.

In FIG. 6 is shown a yet further arrangement in which each of the nine matrixes includes two columns 30 and 31 in which the numbers are exposed and a third column 32 in which the numbers are covered by a scratch-off coating 33. Again the player removes the scratch-off coating to expose the numbers printed underneath and wins a prize depending upon the number of matrixes which properly contain the numbers 1 to 9.

Of course the games are predetermined so that a number of the game tickets are losing tickets and a number of the game tickets are winning tickets. Thus losing tickets may include no proper matrixes or may include less than a predetermined number of proper matrixes so that a winning ticket requires more than the predetermined number. Such arrangements are of course well known to persons skilled in the art of printing lottery tickets.

Figure 7:
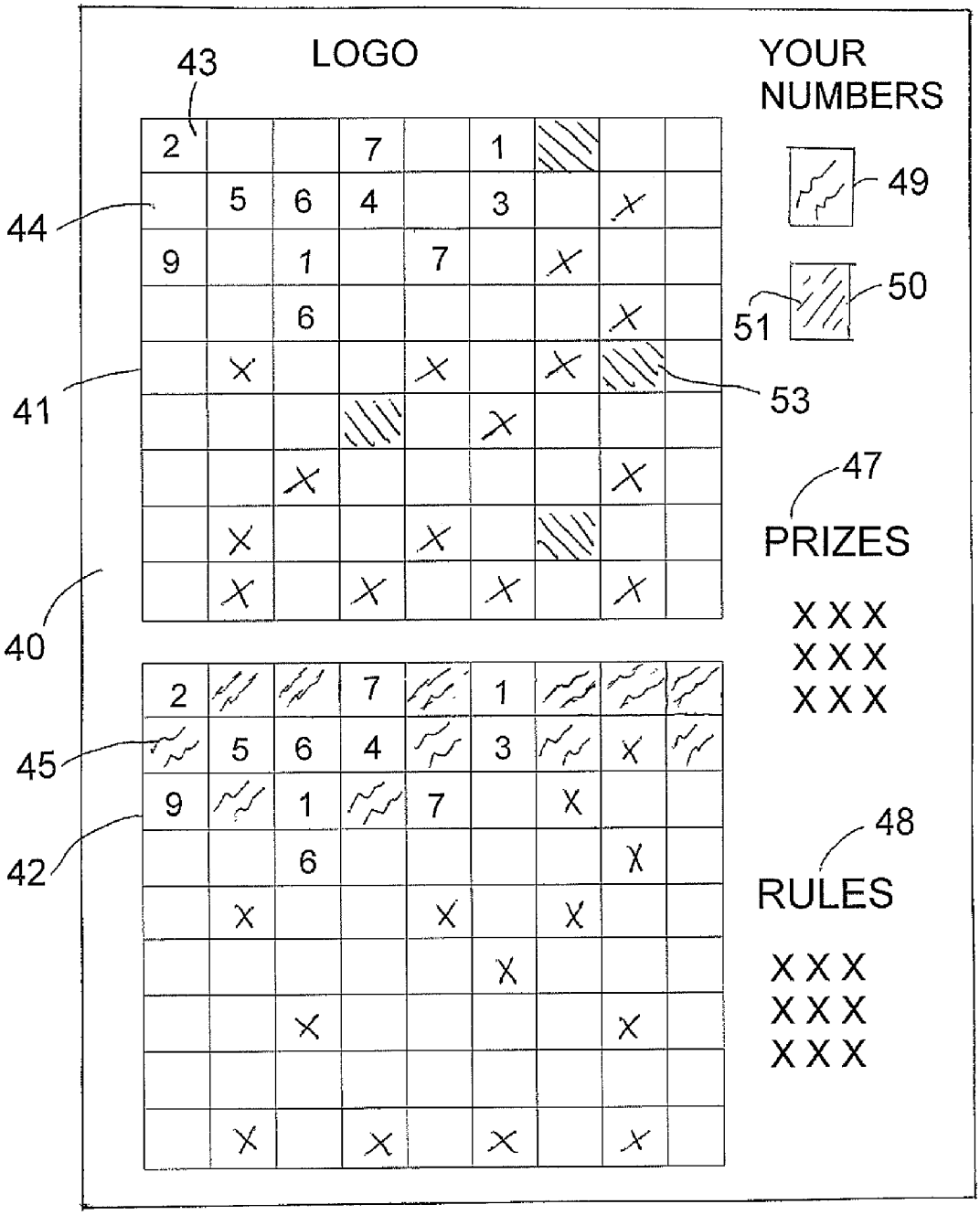
FIG. 7 is a top plan view of a further more complex embodiment according to the present invention.

In FIG. 7 is shown a further more complex arrangement possibly designed for more sophisticated players. In FIG. 7 is shown a ticket or substrate indicated at 40 which contains a first matrix 41 and a second identical matrix 42. Each of the matrices is formed in a nine by nine grid.

The first matrix 41 is arranged with a number of marked locations 43 and a number of blank or unmarked or open locations 44. The matrix is set up with a series of predetermined numbers selected from the numbers 1 to 9 which are pre-selected and pre-located in specific locations on the matrix.

The open locations 44 on the matrix are available to be filled in by the player with the intention that the player selects numbers to be inserted so that the rows and columns follow the rules set forth above that each row and each column contains exactly the numbers 1 to 9 with each number not being duplicated. In most cases also the game requires that the nine separate three by three grids within the matrix also contain the number 1 to 9 once only.

The pre-selected numbers are selected and located so that the problem can properly be solved so that the rows and columns fulfill this requirement. The techniques by which the numbers are pre-selected and located are well known to persons skilled in the art of puzzle development.

The second matrix 42 is identical to the first matrix 41 and contains exactly the same pre-selected numbers in exactly the same pre-selected locations. However the difference of the second matrix 42 is that the solution to the puzzle, that is the selection and location of the numbers to be inserted in the open locations is pre-printed onto the locations within the second matrix. These locations are then covered by a scratch-off coating 45 so that the solution to the puzzle is covered by the scratch-off coating 45.

In a first mode of use of the ticket of FIG. 7, therefore, the player can conventionally solve the puzzle defined by the matrix 41 and enter all of the selected numbers in the selected locations to solve the puzzle. If the player chooses to do so either because of difficulty or frustration or laziness, the player can expose the number under a particular location in the matrix 42 allowing the player to determine the correct answer at that location and can then transfer that answer into the matrix 41. Thus the second matrix can assist less skilled players to solve the puzzle defined by the matrix 41.

In a second method of play of the ticket of FIG. 7, the ticket can act as an instant win ticket. Thus the ticket can provide a prize as defined in a prize location indicated at 47 based upon rules set out in a location indicated at 48. The fact as to whether the ticket is a winning or losing ticket is necessarily predetermined. The fact is also covered by a scratch-off coating so that whether the ticket is a winning or losing ticket cannot be determined without scratching a location on the ticket to expose an identifying element on the ticket.

In the example shown, the ticket includes one or more locations indicated at 49 and 50 where a number is printed but covered by scratch-off coating 51. In this embodiment the player exposes the number or numbers as printed in the area or areas 49 and 50.

In this embodiment certain ones of the locations in the matrix are visually identified as indicated at 53 to be distinct from other locations in the matrix. The ticket is a winning ticket if the number or numbers exposed by scratching locations 49 and 50 is the same number that appears in the visually distinct location 53. In other words, if the correct answer at location 53 is the same number which appears at location 49 or 50 then the ticket is a winning ticket. The prize can of course be multiplied if the number appears in more than one of the visually distinct locations 53.

As the matrix 42 provides the accurate answer, in the event of a dispute or an error by the player which provides a wrong number in the visually distinct location 53 then this can be checked by looking at the corresponding location on the second matrix 42.

Other types of prize winning arrangement can be used. For example the locations 49 and 50 may identify particular locations on the matrix and the ticket becomes a winning ticket if a particular number appears on that location.

Persons skilled in the art of puzzle development can identify other techniques for generating a determination of whether the ticket is a winning or losing ticket based upon scratch-off locations 49 and 50 in relation to the present material in the matrix 41.

Thus the present arrangement provides different levels of sophistication for tickets using the concept of the above numerical game which allow extended play for the player depending on the level of sophistication of the player and at the same time provide the possibility for the player to win significant or other prizes based upon a predetermined status of the ticket purchased. That's where that ticket is a winning or losing ticket. The ticket can therefore use conventional validation techniques since the lottery has a listing of the ticket and ticket identifying numbers or validation number and the validity of that ticket together with the prize amount to be paid regardless of the skill of the player.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A lottery ticket comprising:

a substrate having printed thereon:

a plurality of matrices each defining nine locations for a game symbol;

the locations having printed therein numbers selected from the numbers 1 to 9;

at least one of the locations having the number thereof covered by a scratch-off coating such that the number is covered but can be exposed by a player removing the scratch-off coating;

wherein the ticket has the characteristic that a prize is won if a sufficient number of the matrices contains in each of the nine locations defined thereby a respective one of the numbers 1 to 9 with each number appearing once only.

2. The lottery ticket according to claim 1 wherein all of the locations are covered by scratch-off material.

3. The lottery ticket according to claim 1 wherein only some the locations are covered by scratch-off material.

4. The lottery ticket according to claim 1 wherein at least one of the numbers associated with a respective one of the locations is a play number covered by scratch-off material which is positioned on the substrate at a separate position from the location itself.

5. A lottery ticket comprising:

a substrate having printed thereon:

a plurality of matrices each defining nine locations for a game symbol;

wherein there are nine matrices arranged in three by three grids;

the locations having printed therein numbers selected from the numbers 1 to 9;

at least one of the locations having the number thereof covered by a scratch-off coating such that the number is covered but can be exposed by a player removing the scratch-off coating;

wherein the ticket has the characteristic that a prize is won if a sufficient number of the matrices contains in each of the nine locations defined thereby a respective one of the numbers 1 to 9 with each number appearing once only.

6. A lottery ticket comprising:

a substrate having printed thereon:

a plurality of matrices each defining nine locations for a game symbol;

wherein the matrices are arranged in nine rows and nine columns to form a complete grid of nine by nine defining a total number of eighty one locations;

the locations having printed therein numbers selected from the numbers 1 to 9;

at least one of the locations having the number thereof covered by a scratch-off coating such that the number is covered but can be exposed by a player removing the scratch-off coating;

wherein the ticket has the characteristic that a prize is won if a sufficient number of the matrices contains in each of the nine locations defined thereby a respective one of the numbers 1 to 9 with each number appearing once only.

7. A lottery ticket comprising:

a substrate having printed thereon:

a plurality of matrices each defining n locations for a game symbol, where n is an integer in the range 2 to 9;

the locations having printed therein numbers selected from the numbers 1 to n;

at least one of the locations of each matrix having the number thereof covered by a scratch-off coating such that the number is covered but can be exposed by a player removing the scratch-off coating;

wherein the ticket has the characteristic that a prize is won if a sufficient number of the matrices contains in each of the n locations defined thereby a respective one of the numbers 1 to n with each number appearing once only.

* * * * *